US005392533A

United States Patent [19]

Gerhartl

[11] Patent Number: 5,392,533

[45] Date of Patent: Feb. 28, 1995

[54] DISPOSABLE SHOE INSOLE AND METHOD FOR MAKING THE SAME

[75] Inventor: Gerd W. P. Gerhartl, Bichwil, Switzerland

[73] Assignee: Flawa Schweitzer Verbandstoff-und Wattefabriken AG, Flawil, Switzerland

[21] Appl. No.: 946,032

[22] Filed: Sep. 15, 1992

Related U.S. Application Data

[63] Continuation of Ser. No. 559,948, Jul. 31, 1990, abandoned.

[30] Foreign Application Priority Data

Aug. 14, 1989 [CH] Switzerland ..... 2964/89

[51] Int. Cl.[6] ..... A43B 13/38; A43B 9/00

[52] U.S. Cl. ..... 36/43; 36/3 B; 12/142 R

[58] Field of Search ..... 36/43, 44, 71, 3 B; 12/142 N, 146 M, 142 R

[56] References Cited

U.S. PATENT DOCUMENTS

| | | | |
|---|---|---|---|
| 2,313,892 | 3/1943 | Russell | 36/44 |
| 2,917,842 | 12/1959 | Scholl | 36/3 B |
| 3,418,732 | 12/1968 | Marshack | 36/44 |
| 4,062,131 | 12/1977 | Hsiung | 36/44 |
| 4,099,342 | 7/1978 | Singh | 36/44 |
| 4,192,086 | 3/1980 | Sichak | 36/44 |
| 4,257,176 | 3/1981 | Hartung et al. | 428/905 |
| 4,461,099 | 3/1984 | Bailly | 36/44 |
| 4,464,850 | 8/1984 | Ebert et al. | 36/43 |
| 4,524,529 | 6/1985 | Schaefer | 36/44 |
| 4,689,899 | 9/1987 | Larson et al. | 36/44 |
| 4,864,740 | 9/1989 | Oakley | 36/44 |
| 4,926,570 | 5/1990 | Fohst et al. | 36/43 |

FOREIGN PATENT DOCUMENTS

| | | | |
|---|---|---|---|
| 0061505 | 10/1982 | European Pat. Off. | 36/43 |
| 0081070 | 10/1982 | European Pat. Off. . | |
| 0224613 | 12/1985 | European Pat. Off. . | |
| 0369801 | 11/1989 | European Pat. Off. . | |
| 0370413 | 11/1989 | European Pat. Off. . | |
| 2617688 | 1/1989 | France | 36/44 |

*Primary Examiner*—Paul T. Sewell
*Assistant Examiner*—Beth Anne C. Cicconi
*Attorney, Agent, or Firm*—Jacobson, Price, Holman & Stern

[57] ABSTRACT

The insole contains an absorbent layer (1) which is arranged on a stabilization layer (2). The stabilization layer (2) is made of a fibrous and sealable material, the fibers running predominantly in the longitudinal direction of the insole. On the absorbent layer (1), there is a covering layer (10) which is likewise made of a sealable material. Depressions (20) are provided, the side walls (15) of which are formed by continuations (111, 112) of the material (11, 12) of the covering layer (10). The edges (13) of these side walls (15) are connected rigidly to the stabilization layer (2) so that, between the neighboring depressions (20), there are bridges (25) made from the material of the covering layer (10), which reinforce that section (18) of the stabilization layer (2) lying below.

With the given and minimal thickness, the insole is remarkably rigid and durable.

19 Claims, 2 Drawing Sheets

DISPOSABLE SHOE INSOLE AND METHOD FOR MAKING THE SAME

This application is a continuation of U.S. application Ser. No. 07/559,948, filed Jul. 31, 1990, now abandoned.

The present invention relates to an insole with an absorbent layer and to a process for the manufacture of the same.

Insoles of this generic type are widespread. The absorbent layer of the same is normally made from an absorbent fleece which contains natural and/or synthetic fibers. In one of the known insoles, the underside of the absorbent layer is provided with a layer made of a foamed material which acts as an anti-slip coating. The fleece of the absorbent layer has a negligible stiffness. The foamed material also has little stiffness so that this known insole is in fact very flexible. This renders more difficult the introduction of the insole into the area of the toe of the shoe. Considering that the layer of foamed material on the underside of the insole forms an anti-slip protection, then it follows that it is very arduous to insert the known insole into a shoe.

The object of the present invention is to indicate an insole which does not have the stated disadvantage and which above and beyond this offers additional advantages.

Figure 1:
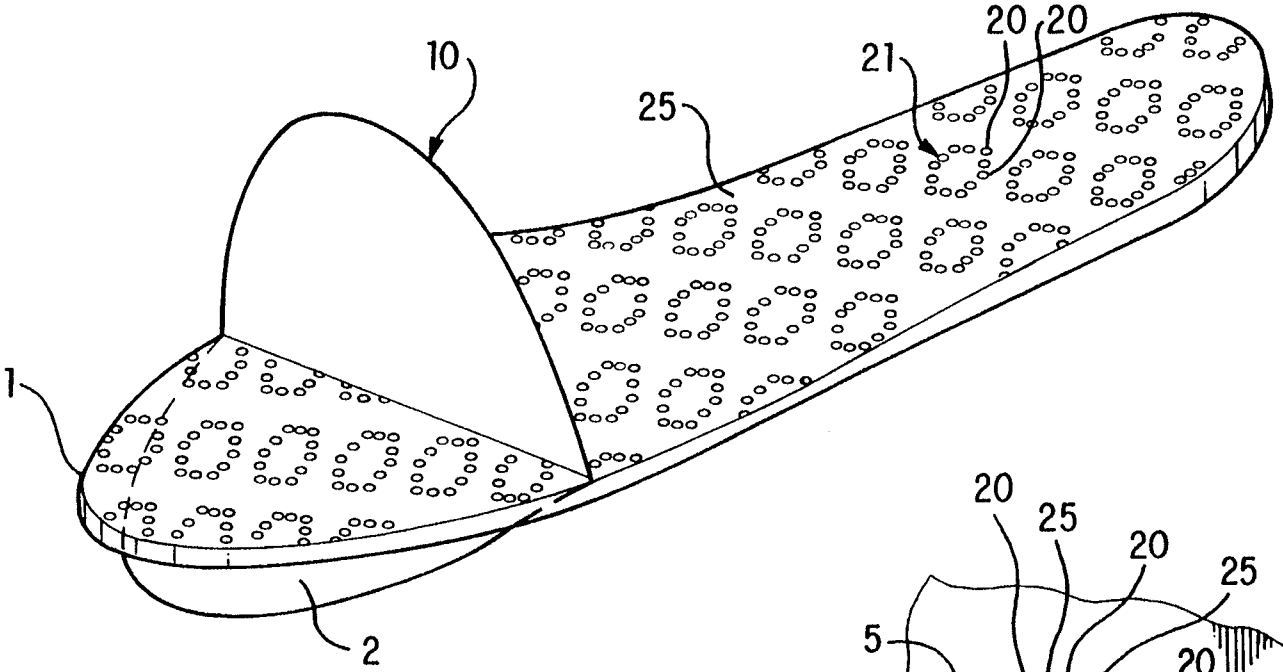
Figure 3:
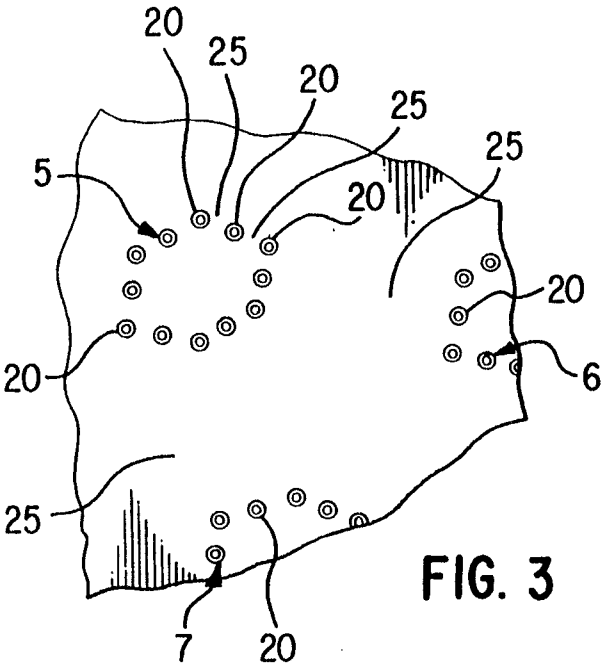
Figure 2:
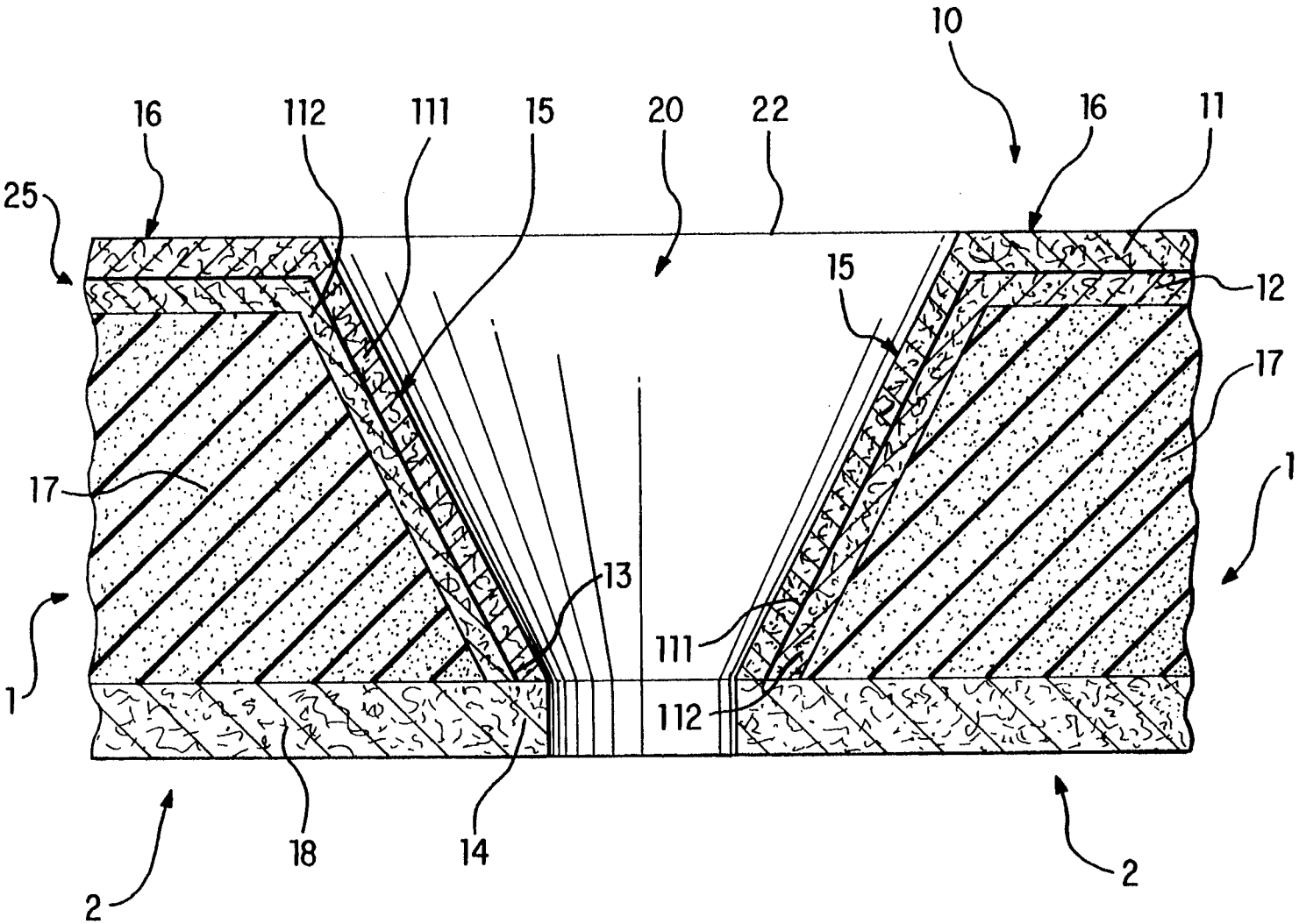

Embodiment possibilities of the present invention are explained in greater detail below with reference to the attached drawing, in which:

FIG. 1 shows in perspective the present insole which consists of a plurality of layers and in which in the toe area of the same the outer layers are pulled back partially, FIG. 2 shows on an enlarged scale a detail from a vertical section through the insole according to FIG. 1, this detail including one of the holes made in the insole, and FIG. 3 shows a detail from a pattern which is formed by the holes made in the insole.

The insole, which is represented in perspective in FIG. 1, has an absorbent layer 1, the thickness of which in the finished product is essentially determined by the thickness of this product. In the finished product, the thickness of the absorbent layer 1 lies between 1 mm and 5 mm approximately. The absorbent layer 1 extends advantageously over the entire surface of the insole. Loosely carded wadding or else wadding scraps, which are obtained in the manufacture of other wadding products, can form the material of this absorbent layer 1. The wadding can consist exclusively of cotton fibers or it can be a mixture of different fibers. For example, this layer can contain cotton fibers and viscose fibers which are connected to one another with the aid of a fiber made of a suitable material. Such a binding fiber can be a synthetic fiber and in particular polyethylene fibers can be used. The absorbent layer can also, however, contain 80% cotton fibers or viscose fibers and 20% polyester fibers.

A stabilization layer 2 is assigned to the absorbent layer 1 and this stabilization layer 2 is situated on that side of the absorbent layer 1 which faces towards the inner sole of the shoe. In FIG. 1, a section of this stabilization layer 2 is lifted off downwards slightly from the absorbent layer 1 in the area of the toe of the shoe. This is because the thickness of the stabilization layer 2 is relatively small in comparison with the thickness of the absorbent layer 1 and it lies within a range of a few tenths of a millimeter. The stabilization layer 2 is designed in such a manner that it imparts to the insole the stiffness necessary to insert the same into a shoe. Furthermore, this layer 2 is designed in such a manner that it acts in a slip-resistant manner during the wearing of the shoe.

The mutual assignment of the said layers 1 and 2 takes place in such a manner that one of the surfaces of the absorbent layer 1 is connected to one of the surfaces of the stabilization layer 2. No special process needs to be used to connect these two layers 1 and 2 because the cohesion of the or of all the layers of the present insole is achieved by means of a special type of perforation of the insole semifinished product. The perforation process is described in greater detail below.

The stabilization layer 2 is made of a fibrous material, in which the fibers form a plurality of plies. The material of this layer must be a sealable material. It can be a fleece or a tissue. If the layer 2 is made of a fleece, then it can advantageously contain viscose fibers. These fibers can be approximately 40 mm long and their thickness can be 3.8 decitex. The fibers of the fleece are connected to one another with the aid of a binder. Such a mixture can contain 75% fibers and 25% binder.

The binder can be based on synthetic rubber. Such a binder effectively resists the slipping of the insole in the shoe. This is because rubber is in general slip-resistant and because this binder, as practically every fiber is surrounded by this binder, is also situated on the outside of the stabilization layer 2.

For the connection of the fleece fibers, another binder than one based on rubber can of course also be used. The underside of the stabilization layer 2 must then, however, be covered at least in places with a slip-resistant material. This additional slip-resistant layer can be combined with the use of the binder on a rubber base, if the slip-resistant action of the binder is to be reinforced. If the additional slip-resistant and non-coherent layer is used, the areas made of slip-resistant material can form patterns with a suitable progression.

The fibers in the fleece of the stabilization layer 2 are arranged in such a manner that they lie parallel to one another. Such a fleece is also designated as longitudinal ply fleece. The direction of the fibers which lie parallel to one another practically coincides with the longitudinal direction of the insole. In certain circumstances, it can be advantageous if there is an angle which differs from zero between the direction of the fibers and the longitudinal direction of the insole. This can be the case, for example, when slipping of the insole at an angle to the longitudinal direction of the shoe or of the insole is to be prevented.

In applications in which no great stress of the insole is expected or in which the insole is to be a product which is very inexpensive to manufacture, the stabilization layer 2 can be made of a tissue. The tissue is to have a surface which is as rough to undulatory as possible. For such purposes, crepe paper, can be used for example.

That side or surface of the absorbent layer 1 which faces away from the stabilization layer 2 is assigned a further layer 10 which can also be designated as covering layer 10. In FIG. 1, a section of this covering layer 10 is slightly lifted off the absorbent layer 1 in the area of the toe of the shoe. This renders possible the illustration of the covering layer 10 used in the drawing, because the thickness of this layer 10 is relatively small and because it lies within a range of a few tenths of a millimeter. The covering layer 10 advantageously completely covers the upper side of the absorbent layer 1 and it consequently forms the upper limit of the insole. The surface ply 10 is designed in such a manner that, although it is permeable for the liquid to be absorbed, mainly foot sweat, it is not moistenable by the liquid. By virtue of this design, the covering layer 10 also forms inter alia a separation piece between the absorbent layer 1 and the foot of the shoe-wearer.

The surface ply 10 is made of fibers which form at least one layer. These fibers must be made of a relatively tear-resistant material because the body weight of the user of the present insole is supported by these fibers, as will become clearer from the following description. Furthermore, the material of these fibers must be sealable. The fibers of the surface ply 10 can form a fleece or a web.

In FIG. 2, a detail from a vertical section through the insole according to FIG. 1 is represented on a considerably enlarged scale. This detail also includes inter alia one of the holes made in the insole. It can further be seen from FIG. 2 that the surface ply 10 has two layers 11 and 12. The first layer 11 is situated on the outside of the surface ply 10. The second layer 12 is arranged on that side of the surface ply 10 which faces towards the absorbent layer 1. The layers 11 and 12 are fiber layers and the fibers of these layers 11 and 12 consist of different materials. The layers 11 and 12 are connected closely to one another so that they cannot be separated from one another. This close connection of the fiber layers 11 and 12 can be achieved by lamination for example. In the transition area between such layers 11 and 12, a mixture of the fibers of both types is present.

The liquid is not stored in the surface ply 10. This is because this ply 10 is very thin and because the materials of the part layers 11 and 12 are not moistenable by the liquid. The upper, or outer, layer 11 of the surface ply 10 contains mainly fibers made of a material which is repellent to the liquid and which is very tear-resistant. The fibers of this upper layer 11 can be made of polypropylene. The density of this upper layer 11 is selected in such a manner that the liquid can pass through this layer 11 without the passage of the same being subjected to any significant resistance by the upper layer 11.

The lower, or inner, layer 12 of the covering ply 10 contains predominantly fibers made of a material which renders possible a connection between the fibers of the upper layer 11 of the surface ply 10 and the fibers of the absorbent layer 1. The fibers of this inner layer 12 are, for example, made of polyethylene. The binding layer 12 consequently serves as an adhesion agent between the polypropylene fibers of the upper layer 11 and the calibrated (pressed together) wadding of the absorbent layer 1.

The insole has depressions or holes 20 which have been made in the latter from the upper side of the insole or from the covering layer 10 of the same. These holes 20 are inter alia intended to allow or promote a flow of air transversely through the insole. They are moreover responsible for the fact that the insole is so sturdy.

The holes 20 are made in such a manner that the layer material or the layered body 1, 2 and 10 of the insole is guided between heated rollers of a calender. The rollers have projections, the height of which is practically equal to the thickness of the insole and which can, for example, be thorn-shaped. When such projections are pressed into the upper side of the layer material during calendering, the front surfaces penetrate to the stabilization layer 2 of the layered body. As the fibers of the covering layer 10 are thermoplastic and sealable, the fibers or sections of the same which are situated in the area of action of the respective thorn are, after appropriate heating, taken along and drawn into the depth of the layered body by the front surface of the projection and by the sides of the same.

In FIG. 2, a vertical section through the layered body in the area of one of the holes 20 is shown schematically. It can be seen from FIG. 2 that the front surface of the thorn, during the penetration of the same into the layered body, broke through the part layers 11 and 12 of the covering ply 10 and that the sides of the thorn have drawn the softened material of the part layers 11 and 12 into the depth of the opening 20. As a result of this, sections 111 and 112 of the part layers 11 and 12 which are situated on the inside of the hole 20 and which form the walls or side walls of this hole 20 were created. It is true that the layer sections 111 and 112 continue to lie one on top of the other but, because of the drawing effect of the projection side or sides, these layer sections 111 and 112 extend over the entire depth of the layered body to the stabilization layer 2.

As the stabilization layer 2 has also been heated during calendering by the roller opposite, the material of the layer sections 111 and 112 melted together with the material of the stabilization layer 2. The layer sections 111 and 112 have become thinner during drawing into the depth and for this reason they can have a length which is greater than the diameter of the open mouth 22 of the hole 20. Under such circumstances, the thickness of the insole can be greater than the diameter of the upper mouth 22 of the depression 20 in the area of the covering layer 10. These conditions can be varied by means of the choice of thickness of the individual layers, of the material of these layers, of the dimensions of the projections as well as by means of the choice of temperature used.

It can be imagined that, left and right of the hole 20 represented in FIG. 2, there is in each case a further and practically identically designed hole 20 in the insole. To this end, it can be imagined that the picture according to FIG. 2 is divided into two halves along a vertical plane in the center of the hole 20, that these halves are interchanged and that the broken-off parts of the halves are connected to one another.

The inner, or lower, edges 13 of the layer sections 111 and 112 (FIG. 2) in the neighboring holes 20 are, as has been explained, welded together with the adjacent edge 14 of the stabilization layer 2. The layer sections 111 and 112 in a hole 20 together form a side 15. The sides 15 in two neighboring holes 20 form, together with that part 16 of the undeformed part layers 11 and 12 of the covering layer 10 which lies between these sides 15, a skin 25 which covers that section 17 of the absorbent layer 1 lying below it. The skin 25 is three-dimensional because it also in fact extends to the remaining neighboring holes 20. Between this skin 25 and that section 18 of the stabilization layer 2 which lies below, the absorbent layer section 17 is enclosed. This section 17 of the absorbent layer 1 is moreover also pressed together between the skin 25 and the stabilization layer 2, which is a result of the manner of production of the holes 20 with the aid of the calender.

The insole has a very large number of holes 20 which can be grouped together into patterns of suitable shape. In FIG. 3, an example of such a pattern is shown. The picture according to FIG. 3 represents a detail from FIG. 1. In the pattern illustrated, the holes 20 form hexagons 5, 6 and 7. A hole 20 is made in each corner as well as in the center of each side of the hexagons 5 to 7. The skin 25, which if looked at in a vertical section can also be designated as a bridge, extends in each case between two neighboring holes 20. In FIG. 2, the skin 25 appears much more as such a bridge. The skin 25 extends not only between the neighboring holes 20 of one of the hexagons but also between the holes 20 of neighboring hexagons 5 and 6 and 7, which brings about the three-dimensional shape of the skin 25.

The skin 25 is arched and the end parts 13 of the same are, as explained, welded onto the edges 14 of the stabilization layer 2. The arched sections 25 of the covering layer 10 have, by virtue of their three-dimensional shape, a quite considerable rigidity. The sections 15 and 16 of the covering layer 10, which stretch between the ends 13 of the skin 25, consequently reinforce those sections 18 of the stabilization layer 2 which extend between the opposite welding points of a skin 25. The stabilization layer 2, which is inherently flexible, is imparted great rigidity by means of the connection to the individual sections 25 of the covering layer 10, so that as a result the insole in the end gains the exceptional rigidity. In this connection, it is unimportant whether the hole 20 continues in the stabilization layer 2 also or stops at this layer 2. It is only critical that the edges 13 of the skin 25 are welded together with the stabilization layer 2. As can be seen from FIG. 1, the diameter of the holes 20 is significantly smaller than the distance between two neighboring holes 20. The weakening, to which the insole is subjected by the respective hole 20, is even overcompensated by the rigidity of the skin 25 lying between.

The fibers of the stabilization layer 2 are held together by a binder. As it is a longitudinal ply fleece, the inherent rigidity of fleece in the longitudinal direction of the same, that is to say in the longitudinal direction of the fibers forming the fleece, is greater than in the transverse direction of the same. For this reason, it is advantageous if the direction of the fibers in the fleece of the stabilization layer 2 coincides with the longitudinal direction of the insole.

The insole can contain active ingredient capsules with deodorant and/or bactericide. These active ingredients are available in the form of a liquid which is contained in microfine gelatin capsules or similar. The capsules can be stored in the covering layer 10 and/or in the absorbent layer 1. Under the effect of body heat as well as the changing stress on the insole, the capsules are burst and the contents of the same are released at the same time. As all capsules are not burst immediately, the active ingredient can be delivered over a longer period of time.

In the manufacture of the present insole, the individual layers 1, 2 and 10 are manufactured separately from one another as individual webs. For the manufacture of such webs, processes known per se can be used. Subsequently, the covering layer 10 is welded together with the absorbent layer 1 in a process known per se and these are then brought together with the stabilization layer 2. This three-layer web is treated in a calender. At least one of the rollers of the calender is provided with projections, the cross-section of which corresponds to the desired cross-section of the holes 20 in the finished product. These projections are distributed over the surface of the roller according that pattern which is desired for the insole. The height of the projections is equal to the height or thickness of the finished insole or it can be a little smaller than the latter. During the manufacturing process, the rollers of the calender are heated to a temperature which corresponds to the properties of the materials selected for the layered web. The distance between the calender rollers is adjusted in such a manner that the projections penetrate completely or almost completely the layered web supplied, so that it is a matter of pressing the layered web rather than of stamping the same.

The sections of the absorbent layer 1, which have been pressed together, form cushions which considerably increase comfort during use of this insole. To achieve the same effect with known insoles, much more material would have had to be used. The welded-together fibers of the layers 2, 11 and 12 moreover cause the cohesion of the individual layers of the insole, without further manufacturing stages being necessary in order to achieve the stated cohesion.

The covering layer 10 keeps the product sturdy and it is responsible for the fact that the insole does not fall apart even in a moist medium and under stress caused by weight and movement.

The covering layer 10 also acts as a membrane and absorption agent to the absorbent layer 1. The inner layer 12 acts mainly as absorption agent. In this manner the covering layer 10 imparts a dry feeling during use of the present insole.

The absorbent layer 1 absorbs foot sweat and bacteria and stores these. If it contains a bactericide, fungicide or similar, the relevant organisms can then be killed.

I claim:

1. A disposable shoe insole comprising:

a flexible absorbent layer;

a flexible bottom stabilization layer on which the absorbent layer is placed, the thickness of the bottom layer being considerably smaller than the thickness of the absorbent layer, wherein said bottom layer is made from a fibrous material having fibers which run predominantly in the same direction, said direction being substantially parallel to a longitudinal axis of said insole, so as to impart to the insole sufficient stiffness necessary to insert the same into a shoe;

A flexible covering layer disposed on the absorbent layer which is permeable to liquid and which is made from a fibrous material, the thickness of the covering layer being considerably smaller than the thickness of the absorbent layer, wherein the covering layer acts as a membrane to pull liquid through to the absorbent layer; and wherein holes extend from the flexible covering layer of the insole at least until the bottom layer, said holes having side walls which are formed as continuations of the material of the covering layer, a deepest portion of each hole being perforated and wherein a portion surrounding the deepest portion of each hole is connected to the bottom layer.

2. The insole as claimed in claim 1, wherein said holes continue at least partly into the bottom layer and wherein the edge of the material continuations is connected together with the edge of the adjacent hole in the bottom layer.

3. The insole as claimed in claim 1, wherein the fibers of the bottom layer are sealable, the fibers of the covering layer are heat-sealable thermoplastic and wherein the fibers of the covering layer are melted together with the material of the bottom layer.

4. The insole as claimed in claim 1, wherein the sections of the covering layer forming the walls of the holes are thinner than the covering layer and wherein the length of said walls is greater than the diameter of an open mouth of the hole.

5. The insole as claimed in claim 1, wherein the diameter of an upper mouth of the hole in the area of the covering layer is smaller than the thickness of the insole.

6. The insole as claimed in claim 1, having a plurality of holes, wherein the side walls in two neighboring holes form together, with that section of the covering layer which lies between these side walls, an arched bridge which covers that section of the absorbent layer lying below it.

7. The insole as claimed in claim 6, wherein said section of the absorbent layer which is enclosed between said bridge and that section of the bottom layer which lies below the bridge is pressed together between the bridge and said section of the bottom layer and forms a cushion.

8. The insole as claimed in claim 6, wherein the holes are grouped together into a number of patterns and wherein the bridges extend not only between the neighboring holes of one pattern but also between the holes of the neighboring patterns so that said bridges are three-dimensional.

9. The insole as claimed in claim 1, wherein the absorbent layer contains fibers from the group consisting of cotton fibers, viscose fibers and cotton and viscose fibers which are held together with the aid of a binding fiber.

10. The insole as claimed in claim 1, wherein the fibers in the bottom layer run predominantly in the same direction and wherein this fiber direction in the bottom layer essentially corresponds to the longitudinal direction of the insole.

11. The insole as claimed in claim 10, wherein the material of the bottom layer is a fleece.

12. The insole as claimed in claim 10, wherein the fibers of the bottom layer are held together by a binder, the binder being synthetic rubber and is placed on an outer surface of the bottom layer.

13. The insole as claimed in claim 10, wherein the fibers of the bottom layer are held together by a binder other than one based on rubber and wherein the underside of the bottom layer is at least partially covered with a slip-resistant material.

14. The insole as claimed in claim 1, wherein the covering layer includes a first upper layer and a second lower layer of different fiber material, the first layer being situated on the outside of the covering layer and containing mainly fibers made of a material which is moisture repellent and which is tear-resistant, the second layer containing predominantly fibers made of a material which renders possible a connection between the fibers of the upper layer and the absorbent layer, said layers being closely connected to one another so that in a transition area between these two fiber layers a mixture of the fibers of both types is present.

15. The insole as claimed in claim 1, wherein the covering layer contains active ingredient capsules from the group consisting of deodorant, fungicide and bactericide.

16. An insole as claimed in claim 9, wherein said binding fiber is polyethylene fiber.

17. The insole as claimed in claim 1, wherein the absorbent layer contains active ingredient capsules from the group consisting of deodorant, fungicide and bactericide.

18. The insole as claimed in claim 10, wherein the material of the bottom layer is tissue.

19. A process for the manufacture of a disposable shoe insole comprising a flexible absorbent layer;

a flexible bottom stabilization layer on which the absorbent layer is placed, the thickness of the bottom layer being considerably smaller than the thickness of the absorbent layer, wherein said bottom layer is made from a fibrous material having fibers which run predominantly in the same direction, said direction being substantially parallel to a longitudinal axis of said insole, so as to impart to the insole sufficient stiffness necessary to insert the same into a shoe;

said method comprising the steps of:

forming holes in a web, which includes the absorbent layer, the bottom layer and the covering layer, with the application of heat, in such a way that the material of the covering layer in the region of the respective hole penetrates through the material of the absorbent layer until it reaches the material of the bottom layer and is connected to the material of this bottom layer; and cutting out an individual insole from the web.

* * * * *